US006053354A

United States Patent [19]

Niemeyer

[11] Patent Number: 6,053,354

[45] Date of Patent: Apr. 25, 2000

[54] CONTAINER WITH HINGED LID ASSEMBLY

[75] Inventor: Duane Niemeyer, Breese, Ill.

[73] Assignee: Contico International, Inc., St. Louis, Mo.

[21] Appl. No.: 09/169,684

[22] Filed: Oct. 9, 1998

[51] Int. Cl.[7] ..... B65D 51/04

[52] U.S. Cl. ..... 220/819; 220/826; 220/836; 220/908

[58] Field of Search ..... 220/908, 909, 220/819, 826, 836, 840, 841, 842, 843, 844, 259, 255, 256

[56] References Cited

U.S. PATENT DOCUMENTS

| | | | |
|---|---|---|---|
| D. 303,307 | 9/1989 | Juergens . | |
| D. 324,440 | 3/1992 | Daugherty . | |
| D. 355,741 | 2/1995 | Craft et al. . | |
| D. 365,428 | 12/1995 | Prout et al. . | |
| D. 388,577 | 12/1997 | Rehrig et al. . | |
| 3,270,902 | 9/1966 | Breault | 220/826 X |
| 3,333,726 | 8/1967 | Belanger | 220/840 X |
| 3,962,750 | 6/1976 | Buss et al. . | |
| 4,253,260 | 3/1981 | Maza et al. . | |
| 4,391,386 | 7/1983 | Moret | 220/819 |
| 4,414,704 | 11/1983 | Reuter | 220/819 X |
| 4,749,101 | 6/1988 | Durkan, Jr. | 220/840 |
| 4,930,649 | 6/1990 | Moser . | |
| 5,092,484 | 3/1992 | Daugherty et al. . | |
| 5,111,958 | 5/1992 | Witthoeft | 220/909 X |
| 5,167,351 | 12/1992 | Prout et al. . | |
| 5,217,135 | 6/1993 | Smith et al. | 2220/908 X |
| 5,248,033 | 9/1993 | Kos et al. | 220/840 X |
| 5,323,923 | 6/1994 | Schauer | 220/908 X |
| 5,356,027 | 10/1994 | Craft et al. | 220/908 X |
| 5,427,265 | 6/1995 | Cautereels et al. . | |
| 5,482,180 | 1/1996 | Smith et al. | 220/908 X |
| 5,683,097 | 11/1997 | Fenton et al. . | |
| 5,758,888 | 6/1998 | Burgan et al. | 220/908 X |

*Primary Examiner*—Nathan J. Newhouse
*Attorney, Agent, or Firm*—Howell & Haferkamp, LC

[57] ABSTRACT

A container comprises a container body, a rearward lid component, a forward lid component and a handle. The container body has a bottom, first and second side walls extending upwardly from the bottom, and first and second end walls extending upwardly from the bottom. The side walls and end walls define a mouth of the container. The rearward lid component is adapted for covering a rearward portion of the mouth. The forward lid component is hingedly attached to the rearward lid component by a first hinge assembly for pivoting movement of the forward lid component relative to the rearward lid component about a first hinge axis. The forward lid component is adapted for covering a forward portion of the mouth. The handle is connected to the first end wall of the container body adjacent the mouth of the container. The handle extends generally along a handle axis. The rearward lid component is hingedly attached to the handle by a second hinge assembly for pivoting movement of the rearward lid component relative to the container body about a second hinge axis.

25 Claims, 13 Drawing Sheets

CONTAINER WITH HINGED LID ASSEMBLY

BACKGROUND OF THE INVENTION

This invention relates generally to containers for holding and transporting various dry and wet substances. More particularly, this invention pertains to containers having hinged lid assemblies.

Containers for the storage and transportation of dry and wet substances, such as foodstuffs or ice, are generally well known. Typically, such containers comprise a container body with an upwardly facing opening at the top of the container body and a lid assembly for covering the opening. Some containers also include wheels to facilitate transportation of the containers and their contents. In some prior art containers, the lid assembly comprises forward and rearward lid components hingedly connected to one another such that the forward lid component can pivot upwardly relative to the container opening to allow access to the interior of the container. In many such prior art containers, the container body and at least some of the lid components are made of polymeric materials molded by conventional methods.

Although the above-described containers are useful and functional, certain shortcomings prevent them from representing an ideal solution. A problem with many such prior art containers is that the hinge assemblies pivotally connecting the forward and rearward lid components are comprised of metal parts that are subject to corrosion, especially in environments where the containers are subjected to moisture (e.g., where the containers are used to store and transport wet food or ice and are subjected to frequent washings). In addition to diminishing the useful life of the container, corrosion of metal hinge components in the lid assembly presents a risk of contamination of the food or ice contained in the interior of the container directly below the lid assembly. Another problem with prior art containers having forward and rearward lid components is that the hinge assemblies do not permit the lid components to be easily separated from one another and from the container. A further problem with some prior art containers is that the lid assemblies are not connected to the container body when the container is fully open and, therefore, the lid assemblies are susceptible to being dislocated from the container body, thereby exposing the contents of the container.

SUMMARY OF THE INVENTION

The shortcomings of the prior art are overcome by the present invention, which provides an improved container and an improved lid assembly. It is an object of the present invention to provide a container lid assembly having functional hinge components that are not susceptible to corrosion. Another object is to provide a container having forward and rearward lid components with a hinge assembly that permits the lid components to be easily separated from one another and from the container when desired. Still another object is to provide a container having a durable structural means for connecting a lid assembly to the container body for pivoting movement relative thereto.

In general, a container of the present invention comprises a container body, a rearward lid component, a forward lid component and a handle. The container body has a bottom, first and second side walls extending upwardly from the bottom, and first and second end walls extending upwardly from the bottom. The side walls and end walls define a mouth of the container. The rearward lid component is adapted for covering a rearward portion of the mouth. The forward lid component is hingedly attached to the rearward lid component by a first hinge assembly for pivoting movement of the forward lid component relative to the rearward lid component about a first hinge axis. The forward lid component is adapted for covering a forward portion of the mouth. The handle is connected to the first end wall of the container body adjacent the mouth of the container. The handle extends generally along a handle axis. The rearward lid component is hingedly attached to the handle by a second hinge assembly for pivoting movement of the rearward lid component relative to the container body about a second hinge axis.

In another aspect of the present invention, a container comprises a container body, a first lid component and a second lid component. The container body has a bottom and a plurality of side walls extending upwardly from the bottom to define a mouth of the container. The first lid component is adapted for covering a first portion of the mouth. The first lid component has a generally tubular hinge member with a pair of longitudinally disposed slots that allow access to an interior of the tubular hinge member. The second lid component is adapted for covering a second portion of the mouth. The second lid component has a pair of tabs extending therefrom. The tabs are moveable within the interior of the tubular hinge member of the first lid component in a manner so that the first and second lid components are in hinging engagement with one another. Each tab has a cross-sectional configuration defined by a major lateral dimension and a minor lateral dimension. Each slot in the tubular hinge portion of the first lid component has a lateral width greater than the minor lateral dimension of the tabs. Therefore, each tab is allowed to pass laterally through the slot when the tab is oriented so that the minor lateral dimension of the tab is aligned with its associated slot to bring the first and second lid components into and out of hinging engagement with one another. The lateral width of each slot is less than the major lateral dimension of each tab so that the tabs are retained within the interior of the tubular hinge member when the tabs are oriented so that the minor lateral dimension is not aligned with the slots.

Other objects and features will be in part apparent and in part pointed out hereinafter.

BRIEF DESCRIPTIONS OF THE DRAWINGS

Corresponding reference characters indicate corresponding parts throughout the several views of the drawings.

DETAILED DESCRIPTION OF THE PREFERRED EMBODIMENTS

Figure 1:
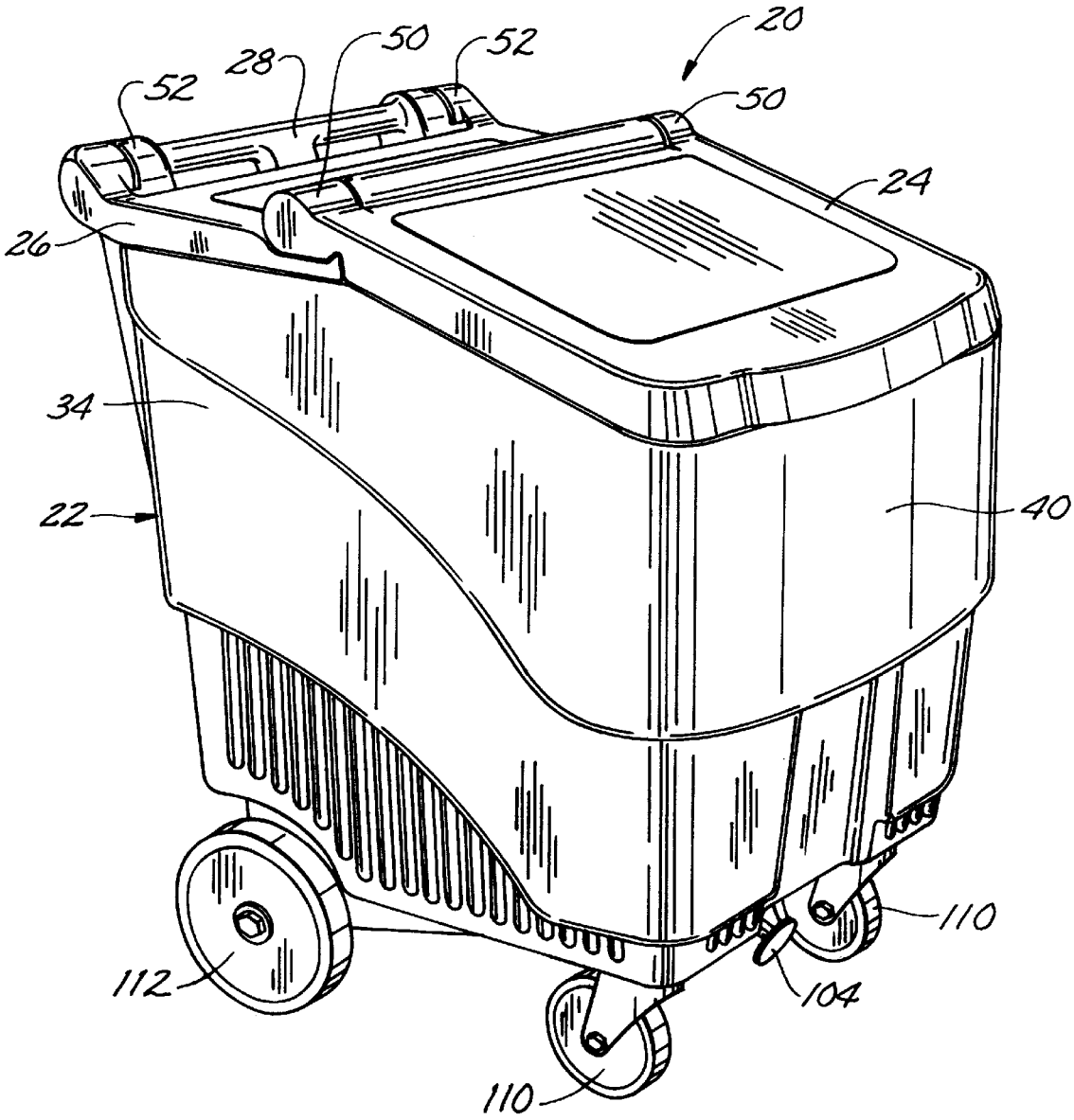
FIG. 1 is a perspective view of a container of the present invention.

The container of the present invention is represented generally by the reference numeral 20 in FIG. 1. In general, the container 20 comprises a container body 22, a forward lid component 24, a rearward lid component 26 and a handle 28.

Figure 2:
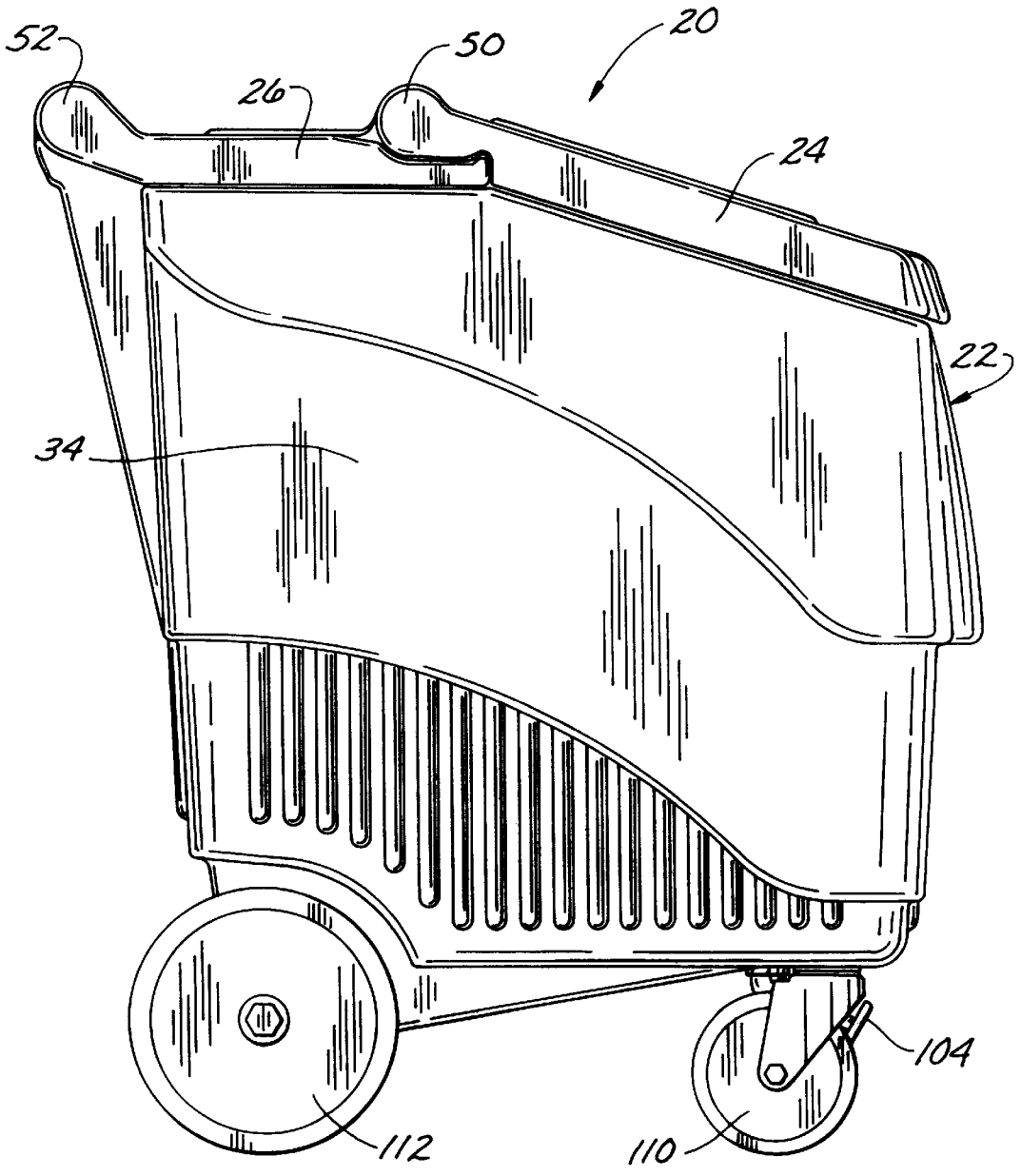
FIG. 2 is a right side elevational view of the container of FIG. 1.
Figure 3:
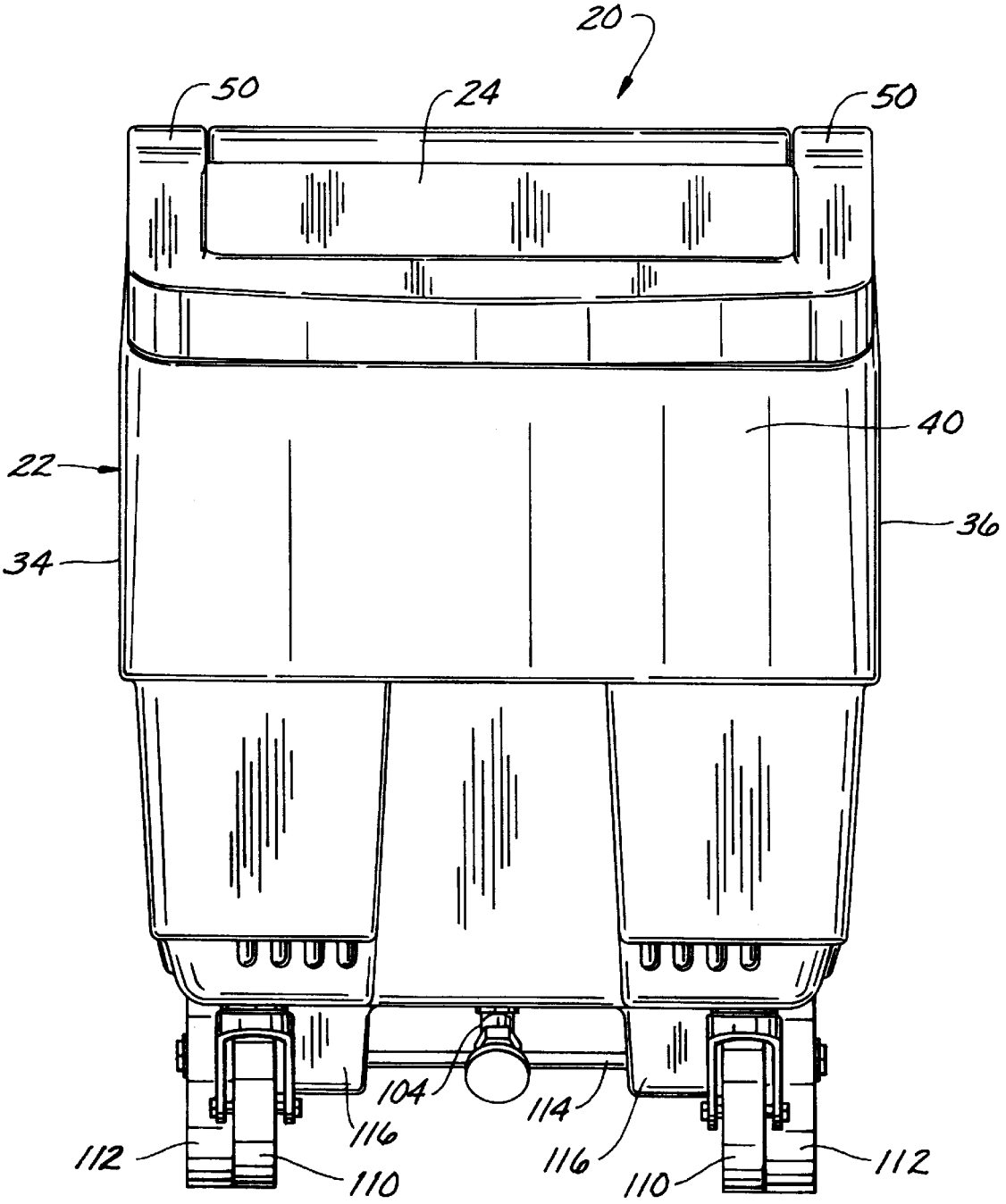
FIG. 3 is a front end elevational view of the container of FIG. 1.

The container body 22 has a container bottom 32 (see FIG. 6), a left side wall 34 (see FIGS. 1 and 2), a right side wall 36 (see FIG. 3), a rear end wall 38 (see FIG. 4), and a forward end wall 40 (see FIGS. 1 and 3). The left and right side walls 34 and 36 and the rear and forward end walls 38 and 40 all extend upwardly from the bottom 32 to define an opening 42 (see FIG. 5) or mouth of the container 22. Preferably, the container body 22 is of a monolithic construction and is made of a polymeric material molded by conventional methods, although other materials and methods of construction could be used without departing from the scope of the present invention.

Figure 5:
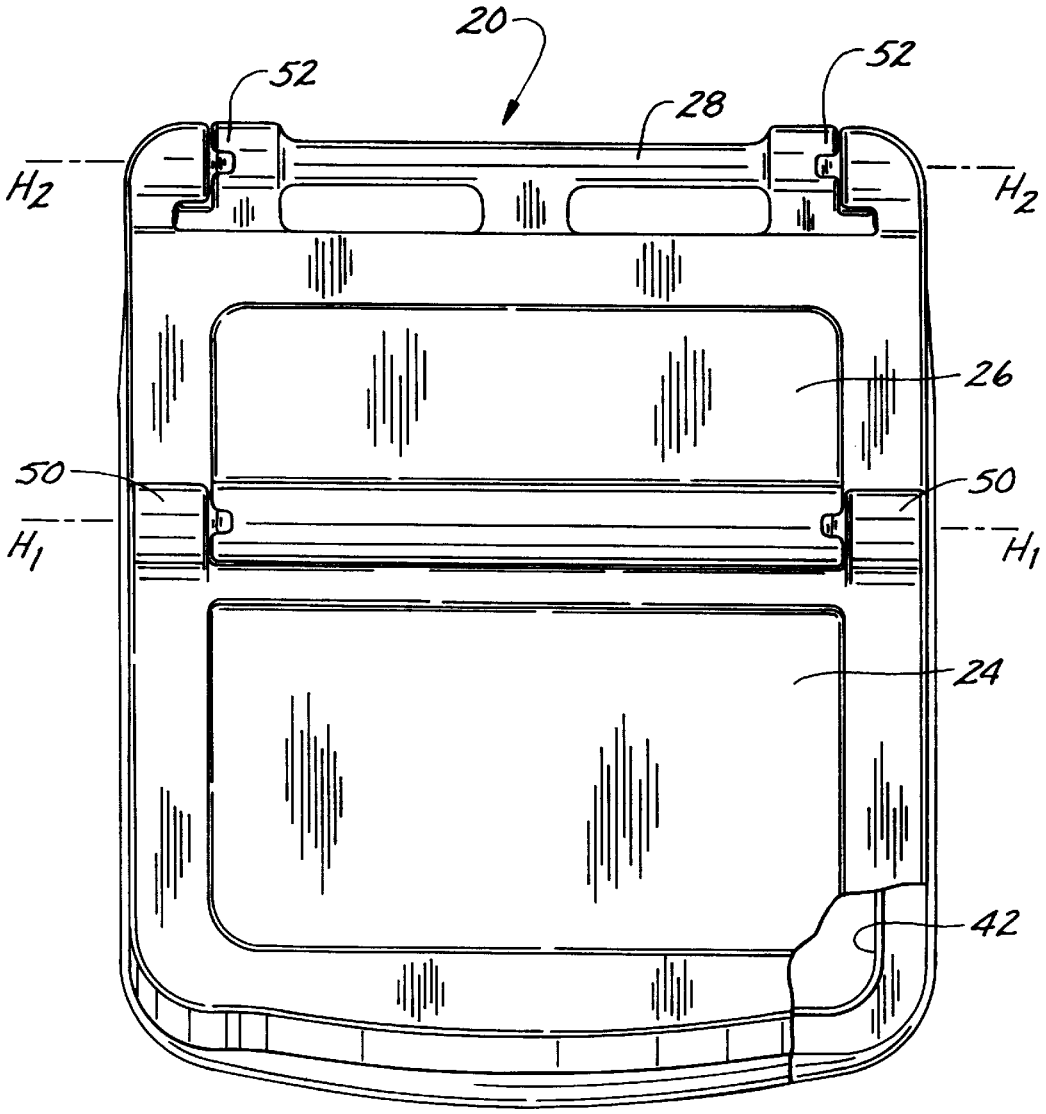
FIG. 5 is a top plan view of the container of FIG. 1 with a forward lid component of the container broken away to show detail.

As best shown in FIGS. 1 and 5, the rearward lid component 26 is adapted for covering a rearward portion of the mouth 42, and the forward lid component 24 is adapted for covering a forward portion of the mouth 42. As described below in greater detail, the forward and rearward lid components 24 and 26 are hingedly attached to one another by a first hinge assembly, represented generally by the reference numeral 50, in a manner to permit pivoting movement of the forward lid component 24 relative to the rearward lid component 26. The forward lid component 24 is adapted to pivot relative to the rearward lid component 26 about a first hinge axis $H_1$ (see FIG. 5). Also, as described below in greater detail, the rearward lid component 26 is hingedly attached to the handle 28 by a second hinge assembly, represented generally by the reference numeral 52, in a manner to permit pivoting movement of the rearward lid component 26 relative to the handle 28 and the container body 22. The rearward lid component 26 is adapted to pivot relative to the handle 28 and relative to the container body 22 about a second hinge axis $H_2$ (see FIG. 5).

Figure 4:
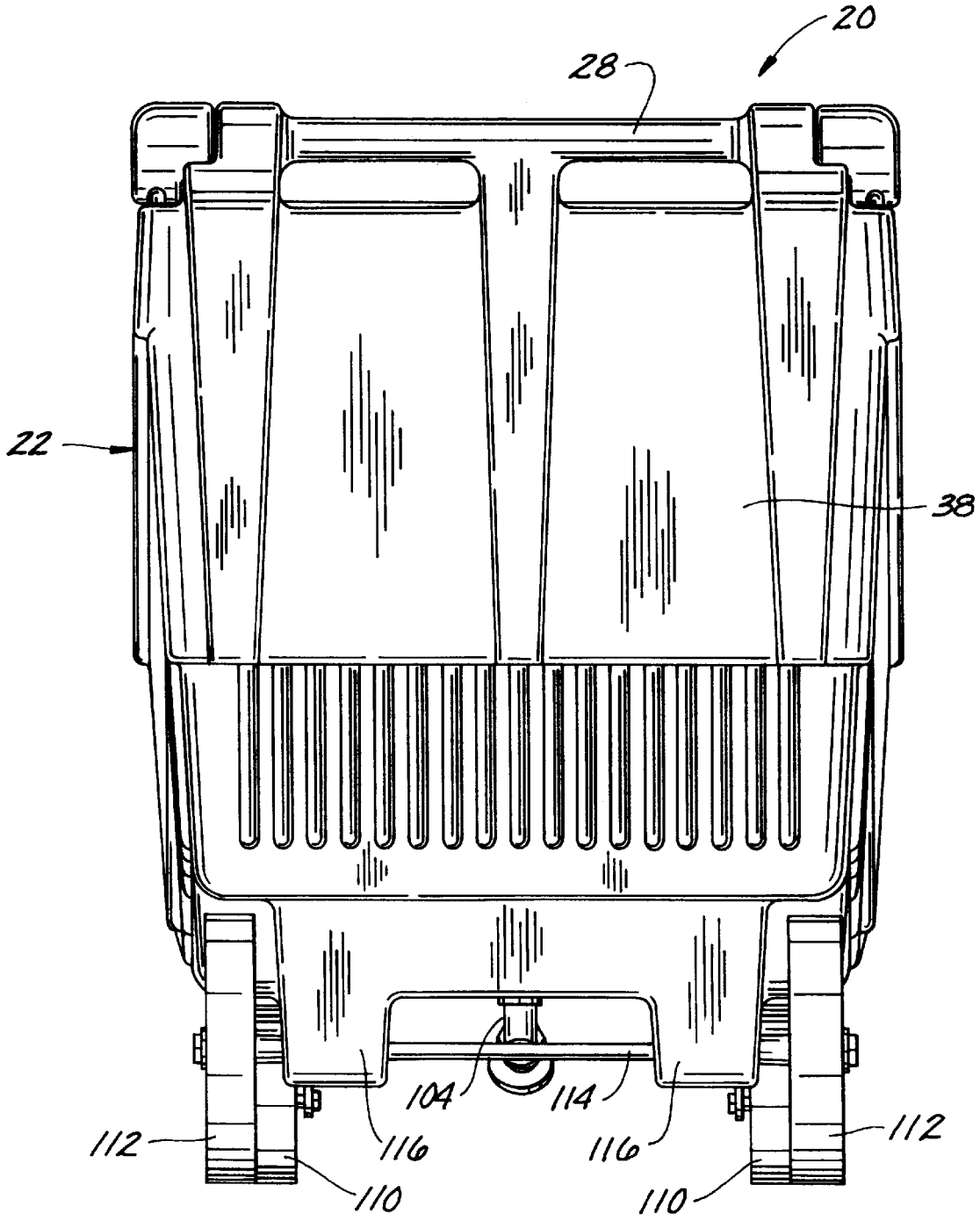
FIG. 4 is a rear end elevational view of the container of FIG. 1.

As shown in FIGS. 4 and 5, the handle 28 is connected to the rear end wall 38 of the container body 22 adjacent the mouth 42 of the container 20. Preferably, the handle 28 is connected to the rear end wall 38 of the container body 22 in a manner so that the handle 28 is spaced from the rear end wall 38. Preferably, the handle 28 and the container body 22 are of a monolithic construction, molded from the same polymeric material. However, the handle could be constructed from other materials without departing from the scope of the present invention. As shown in FIG. 5, the handle extends generally along a handle axis, which is preferably coaxial with the second hinge axis $H_2$.

Figure 7:
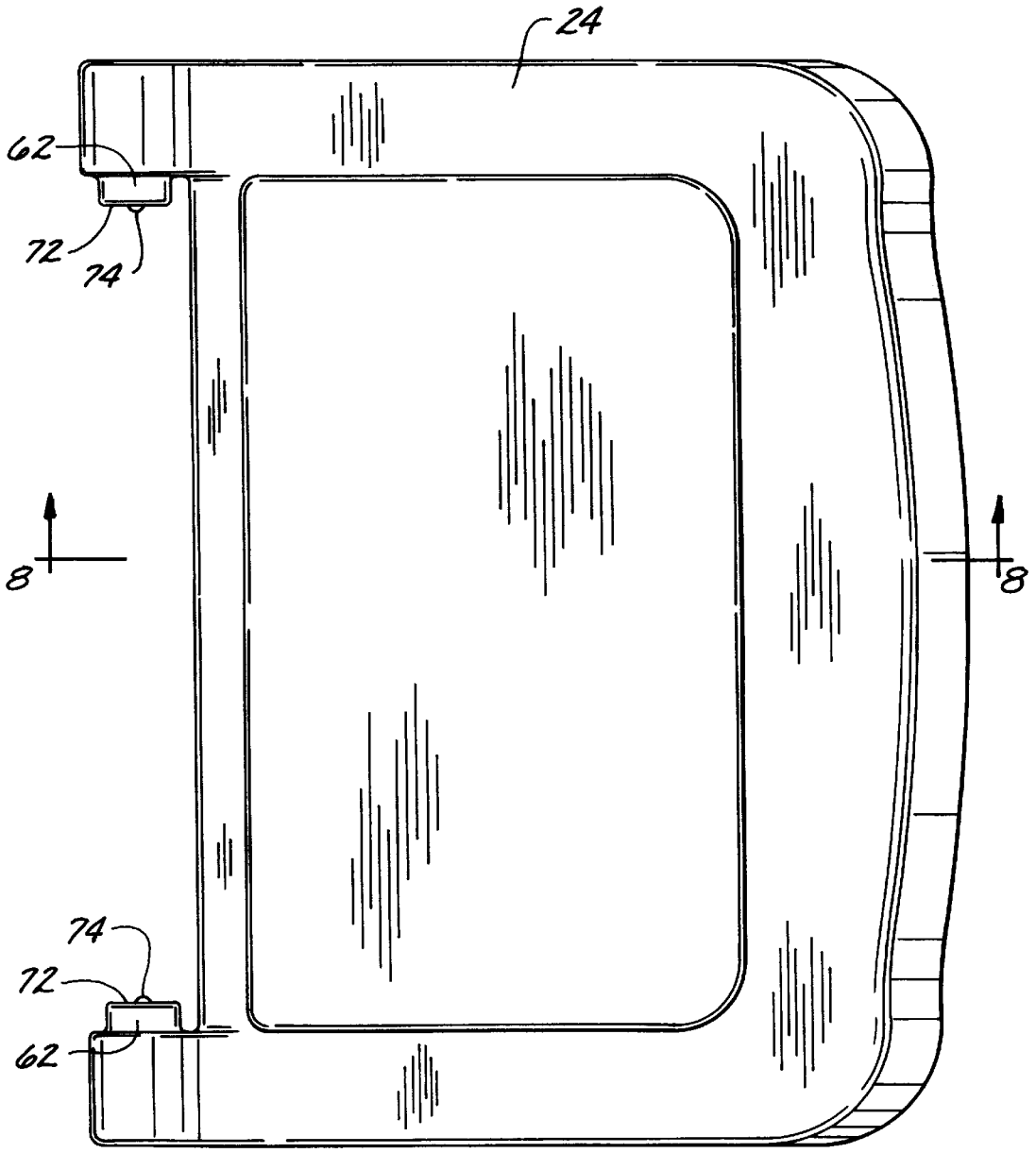
FIG. 7 is a top plan view of the forward lid component of the container of FIG. 1.
Figure 8:
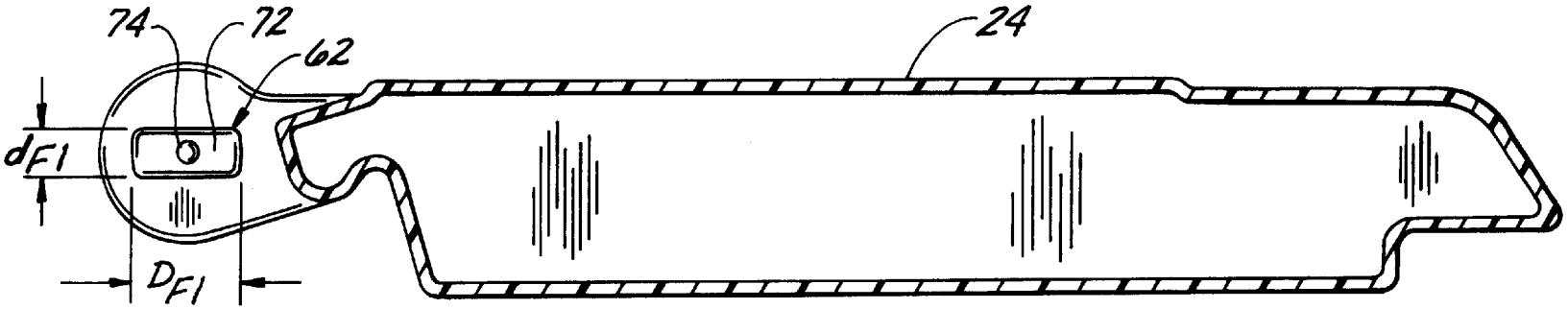
FIG. 8 is a cross-sectional view of the forward lid component taken along the plane of line 8—8 in FIG. 7.
Figure 9:
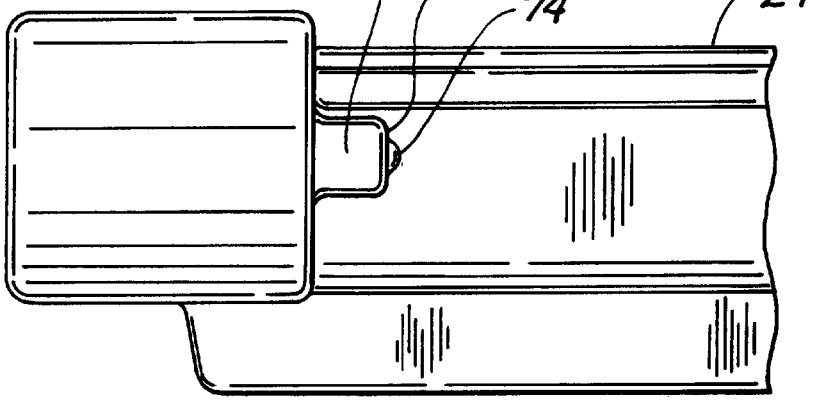
FIG. 9 is an enlarged, fragmented detail view of a hinge tab extending from the forward lid component, viewed from the rear of the forward lid component.

The first hinge assembly 50 includes a first generally tubular hinge member 60 (see FIGS. 10 and 11) and a first pair of tabs 62 (see FIGS. 7–9). Preferably, the first tubular hinge member 60 and the rearward lid component 26 are integral with one another. The tabs 62 extend from the forward lid component 24 and, preferably, the tabs 62 and the forward lid component 24 are integral with one another.

The first tubular hinge member 60 includes a first pair of longitudinally disposed slots 64 that allow lateral access to an interior 66 of the first tubular hinge member 60. The tabs 62 are moveable within the interior 66 of the first tubular hinge member 60 in a manner to permit pivoting movement of the forward lid component 24 relative to the rearward lid component 26. As shown in FIG. 8, each tab 62 preferably has a cross-sectional configuration defined by a major lateral dimension $D_{F1}$ (i.e., width) and a minor lateral dimension $d_{F1}$ (i.e., thickness). Each slot 64 has a lateral width greater than the minor lateral dimension $d_{F1}$ of each tab 62. Therefore, each tab 62 is allowed to pass laterally through its associated slot 64 when the tab 62 is oriented so that the minor lateral dimension $d_{F1}$ of the tab 62 is aligned with the slot 64 to bring the forward lid component 24 into and out of hinging engagement with the rearward lid component 26. The lateral width of each slot 64 is less than the major lateral dimension $D_{F1}$ of the tabs 62 so that the tabs 62 are retained within the interior 66 of the first tubular hinge member 60 when the tabs 62 are oriented so that the minor lateral dimension $d_{F1}$ of the tabs 62 are not aligned with the slots 64.

Thus, the forward lid component 24 is moveable relative to the rearward lid component 26 via the first hinge assembly 50 through a range of positions. One position of said range constitutes a forward-lid-disconnecting-position, wherein the tabs 62 are oriented so that the minor lateral dimension $d_{F1}$ of the tabs 62 is aligned with the slots 64. When in the forward-lid-disconnecting-position, the first tab 62 can pass laterally through the slot 64 and out of the first tubular hinge member 60 to separate the forward lid component 24 from the rearward lid component 26.

Preferably, the first and second hinge assemblies 50 and 52 are constructed entirely of non-metal materials so that corrosion is not an issue. Preferably, the first tubular hinge member 60 and the rearward lid component 26 are of a monolithic construction, molded from the same polymeric material as the container body 22 and handle 28. Also, preferably, the tabs 62 and the forward lid component 24 are of a monolithic construction, molded from the same polymeric material as the container body 22, handle 28, rearward lid component 26 and first tubular hinge member 60. However, the first tubular hinge member 60, tabs 62, forward lid component 24 and rearward lid component 26 could be constructed from other materials (preferably non-corrosive materials) without departing from the scope of the present invention.

The first tubular hinge member 60 and the rearward lid component 26 have been described as being integral with one another and, more preferably, of a monolithic construction. Also, the tabs 62 and the forward lid component 24 have been described as being integral with one another and, more preferably, of a monolithic construction. However, it is to be understood that the first tubular hinge member 60 and the forward lid component 24 may be integral with one another, or of a monolithic construction, without departing from the scope of the present invention. Similarly, the tabs 62 and the rearward lid component 26 may be integral with one another, or of a monolithic construction.

Figure 11:
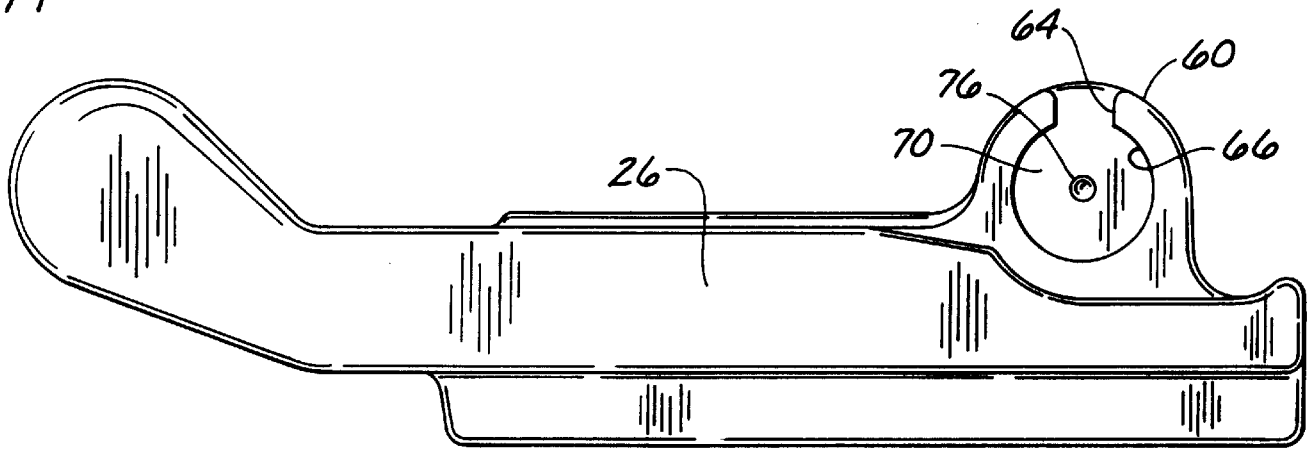
FIG. 11 is a side elevation view of the rearward lid component of FIG. 10.

As shown in FIG. 11, the first tubular hinge member 60 includes an interior end wall 70 at each end thereof (only one end of the first tubular hinge member 60 is shown in FIG. 11) within the interior 66 of the first tubular hinge member 60. Each end wall 70 is generally perpendicular to its associated slot 64. As shown in FIGS. 7–9, each tab 62 includes a distal end surface 72 adapted for abutting engagement with the end wall 70 of the first tubular hinge member 60 when the forward and rearward lid components 24 and 26 are in hinging engagement with one another. Preferably, the distal end surface 72 of each tab 62 includes a projection 74 extending longitudinally away from the distal end surface 72, and the associated end wall 70 of the first tubular hinge member 60 includes a recess 76 adapted for receiving the projection 74 in a snap-fit engagement. The projection 74 is located centrally on the distal end surface 72 of the tab 62 and the recess 76 is generally centered on the end wall 70 in the interior 66 of the first tubular hinge member 60. Preferably, the projection 74 and the recess 76 both lie generally along the first hinge axis $H_1$ so that the projection 74 rotates within the recess 76 as the forward and rearward lid components 24 and 26 pivot relative to one another.

The second hinge assembly 52 is similar in most respects to the first hinge assembly 50 described above. The second hinge assembly 52 includes a second generally tubular hinge member 80 (see FIGS. 14 and 15) and a second pair of tabs 82 (see FIGS. 10, 12 and 13). Preferably, the second tubular hinge member 80 and the handle 28 are integral with one another. The tabs 82 extend from the rearward lid component 26 and, preferably, the tabs 82 and the rearward lid component 26 are integral with one another. The second tubular hinge member 80 includes a second pair of longitudinally disposed slots 84 that allow lateral access to an interior 86 of the second tubular hinge member 80. The tabs 82 are moveable within the interior 86 of the second tubular hinge member 80 in a manner to permit pivoting movement of the rearward lid component 26 relative to the handle 28 and relative to the container body 22.

Figure 12:
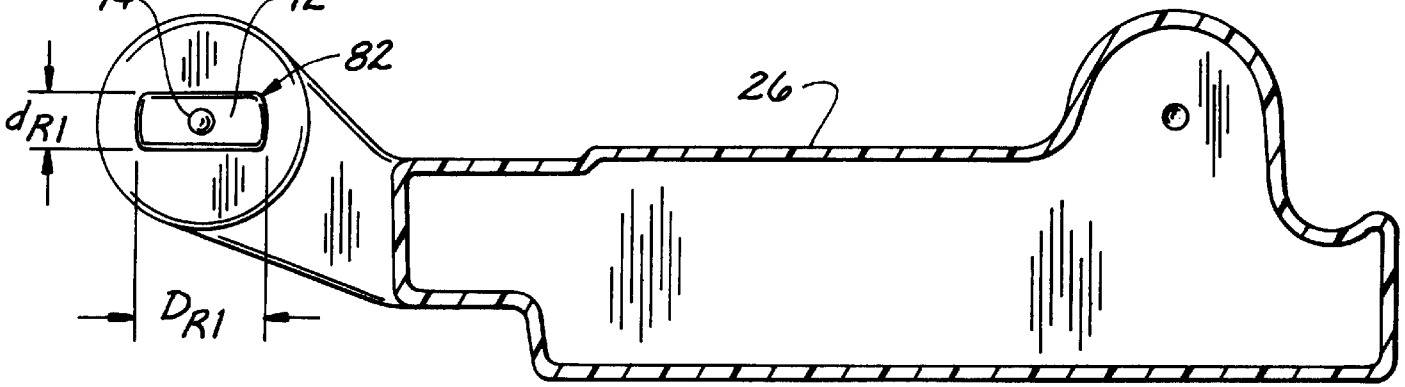
FIG. 12 is a cross-sectional view of the rearward lid component taken along the plane of line 12—12 in FIG. 10.
Figure 13:
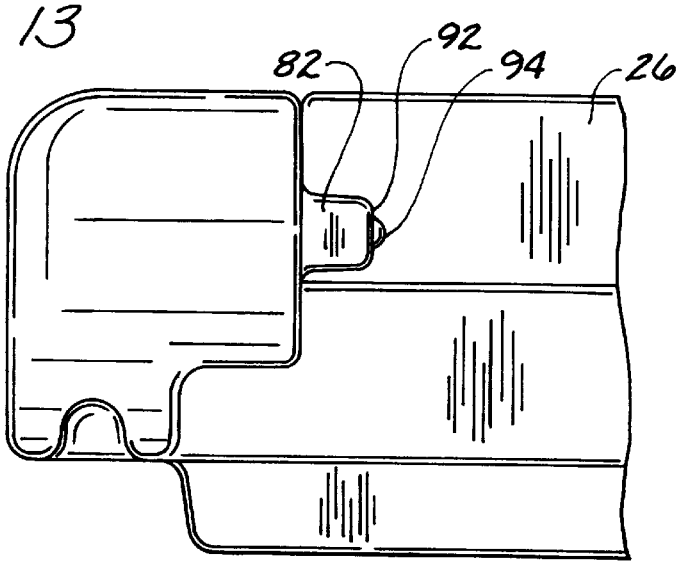
FIG. 13 is an enlarged, fragmented detail view of a hinge tab extending from the rearward lid component, viewed from the rear of the rearward lid component.

As shown in FIG. 12, each tab 82 preferably has a cross-sectional configuration defined by a major lateral dimension $D_{R1}$ and a minor lateral dimension $d_{R1}$. Each slot 84 has a lateral width greater than the minor lateral dimension $d_{R1}$ of each tab 82. Therefore, each tab 82 is allowed to pass laterally through its associated slot 84 when the tab 82 is oriented so that the minor lateral dimension $d_{R1}$ of the tab 82 is aligned with the slot 84 to bring the rearward lid component 26 into and out of hinging engagement with the handle 28 and the container body 22. The lateral width of each slot 84 is less than the major lateral dimension $D_{R1}$ of the tabs 82 so that the tabs 82 are retained within the interior 86 of the second tubular hinge member 80 when the tabs 82 are oriented so that the minor lateral dimension $d_{R1}$ of each tab 82 is not aligned with its associated slot 84.

Thus, the rearward lid component 26 is moveable relative to the handle 28 and container body 22 via the second hinge assembly 52 through a range of positions. One position of the range constitutes a rearward-lid-disconnecting-position, wherein each tab 82 is oriented so that the minor lateral dimension $d_{R1}$ of the tab 82 is aligned with its associated slot 84. When in the rearward-lid-disconnecting-position, the tabs 82 can pass laterally through the slots 84 and out of the second tubular hinge member 80 to separate the rearward lid component 26 from the handle 28.

As with the various components of the first hinge assembly 50 discussed above, preferably, the second tubular hinge member 80 and the handle 28 are of a monolithic construction, molded from the same polymeric material as the container body 22. Also, preferably, the tabs 82 and the rearward lid component 26 are of a monolithic construction, molded from the same polymeric material as the container body 22, handle 28 and forward lid component 24. However, the second tubular hinge member 80 and tabs 82 could be constructed from other materials (preferably non-corrosive materials) without departing from the scope of the present invention.

The second tubular hinge member 80 and the handle 28 have been described as being integral with one another and, more preferably, of a monolithic construction. Also, the tabs 82 and the rearward lid component 26 have been described as being integral with one another and, more preferably, of a monolithic construction. However, it is to be understood that the second tubular hinge member 80 and the rearward lid component 26 may be integral with one another, or of a monolithic construction, without departing from the scope of the present invention. Similarly, the tabs 82 and the handle 28 may be integral with one another, or of a monolithic construction.

Figure 10:
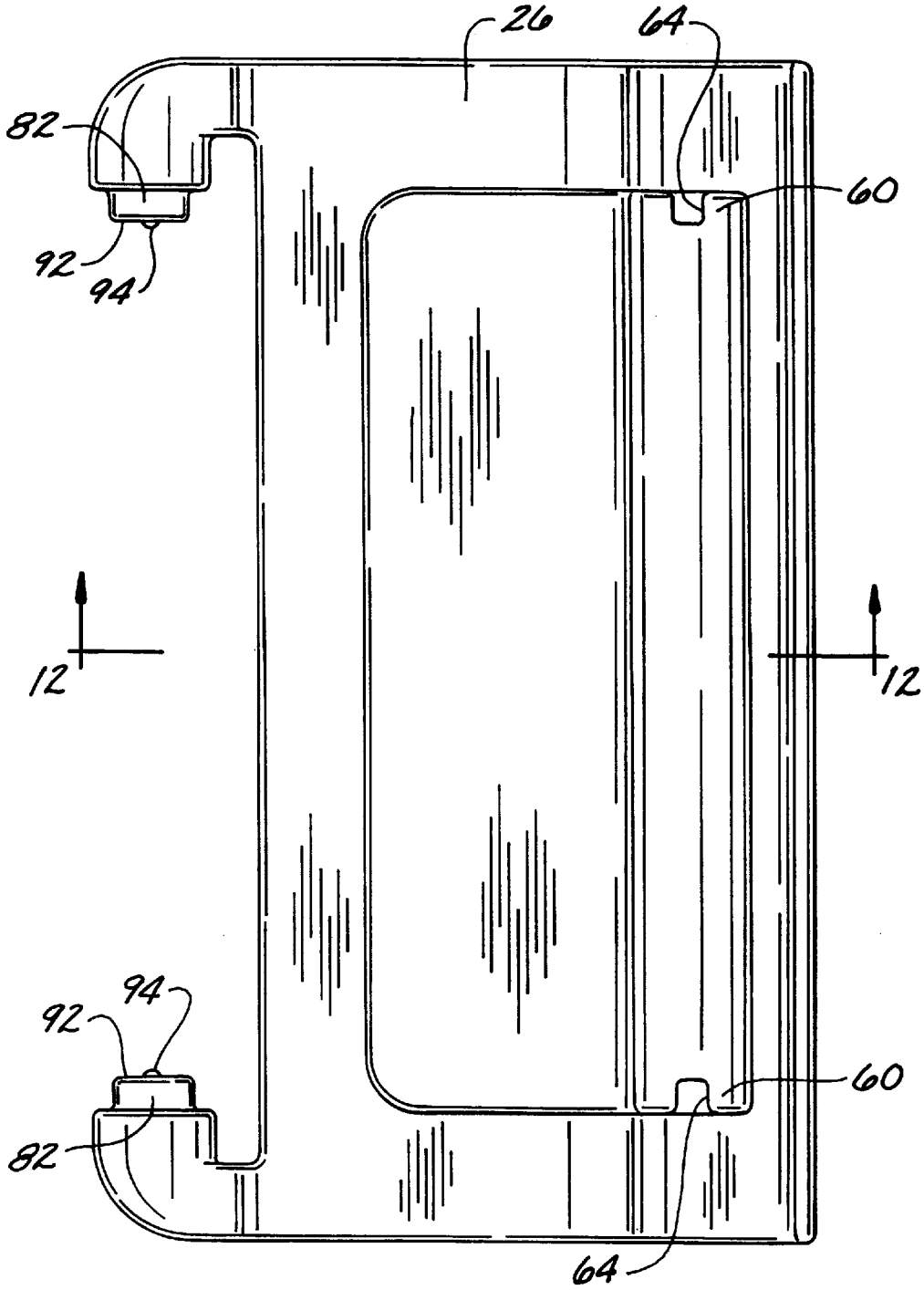
FIG. 10 is a top plan view of a rearward lid component of the container of FIG. 1.
Figure 14:
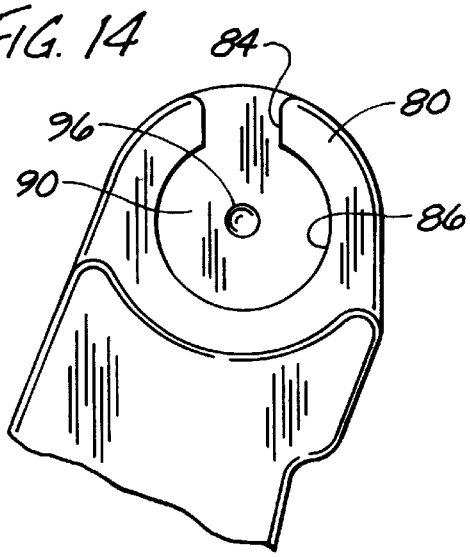
FIG. 14 is an enlarged, fragmented side view of a tubular hinge member of the container body, the tubular hinge member being shown with the rearward lid component removed.
Figure 15:
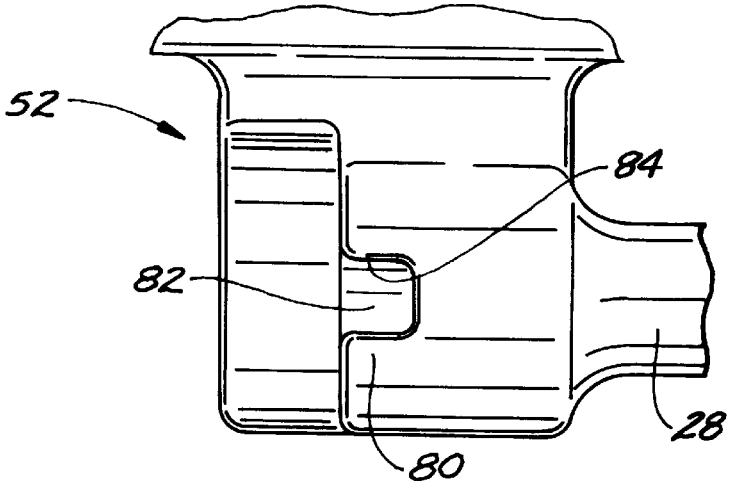
FIG. 15 is an enlarged, fragmented top view of the tubular hinge member of the container body, shown with the rearward lid component removed.

As shown in FIG. 14, the second tubular hinge member 80 includes an interior end wall 90 at each end thereof only one end of the second tubular hinge member 80 is shown in FIG. 14) within the interior 86 of the second tubular hinge member 80. Each end wall 90 is generally perpendicular to its associated slot 84. As shown in FIGS. 10 and 12, each tab 82 includes a distal end surface 92 adapted for abutting engagement with the end wall 90 of the second tubular hinge member 80 when the rearward lid component 26 and the handle 28 are in hinging engagement with one another. Preferably, the distal end surface 92 of each tab 82 includes a projection 94 extending longitudinally away from the distal end surface 92, and the associated end wall 90 of the second tubular hinge member 80 includes a recess 96 adapted for receiving the projection 94 in a snap-fit engagement. The projection 94 is located centrally on the distal end surface 92 of the tab 82 and the recess 96 is generally centered on the end wall 90 in the interior 86 of the second tubular hinge member 80. Preferably, the projection 94 and the recess 96 both lie generally along the second hinge axis $H_2$ so that the projection 94 rotates within the recess 96 as the rearward lid component 26 pivots relative to the handle 29 and the container body 22.

Figure 6:
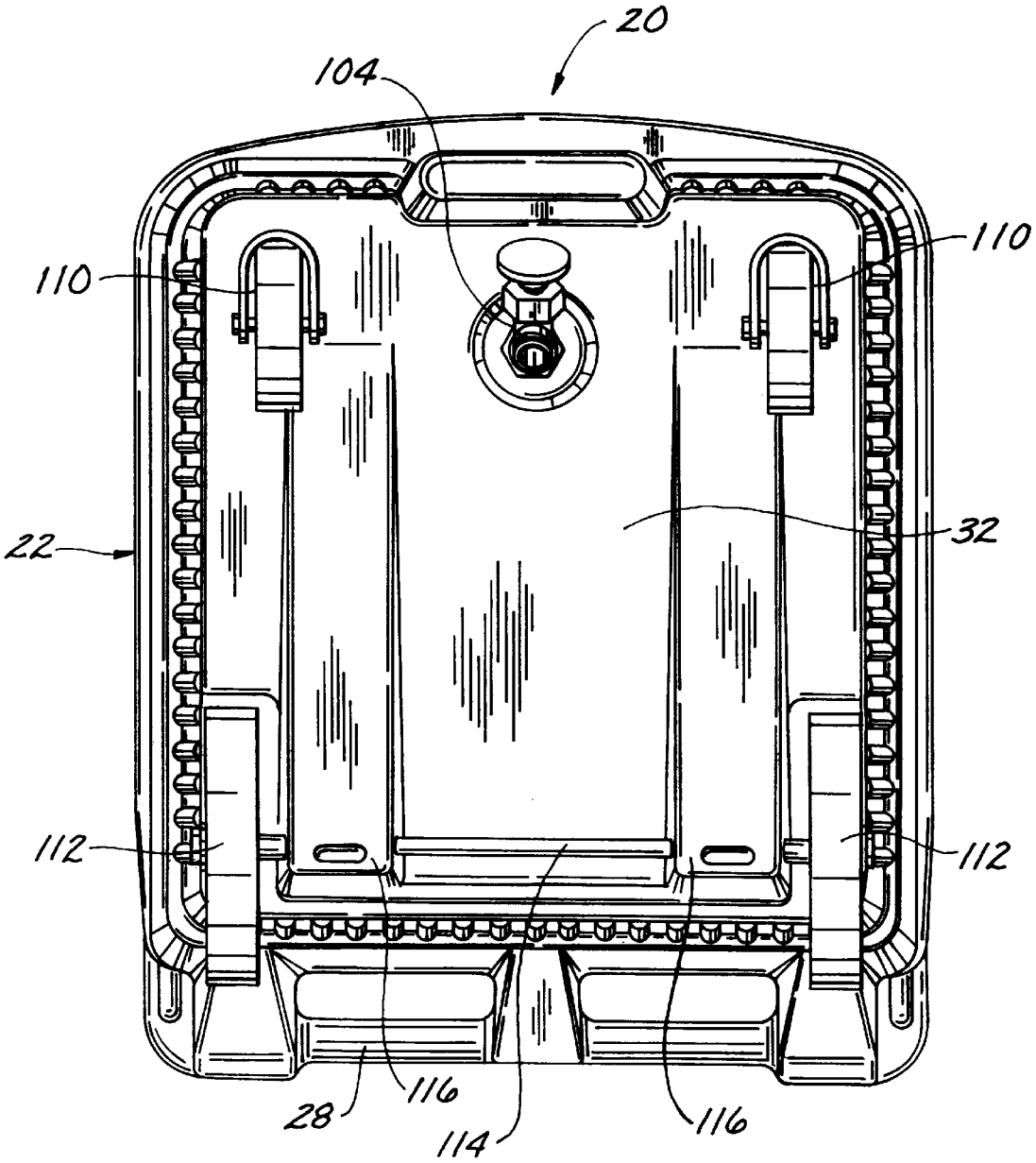
FIG. 6 is a bottom plan view of the container of FIG. 1.
Figure 16:
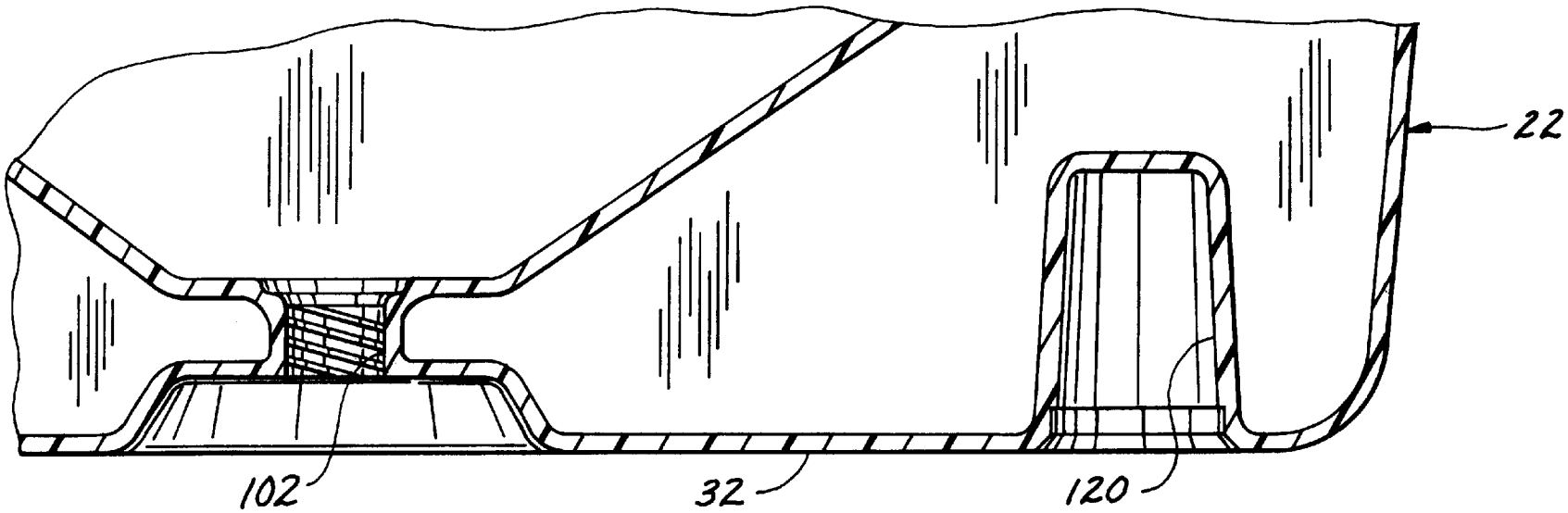
FIG. 16 is a partial cross-sectional view from the front of the container showing detail of a drain valve and a caster socket of the container.

As best shown in FIGS. 1, 6 and 16, the container 20 preferably includes a drain opening 102 with a drain valve 104 near the bottom surface 32 of the container body 22. The drain valve 104 allows easy drainage of liquids, such as melted ice, in the container.

Figure 17:
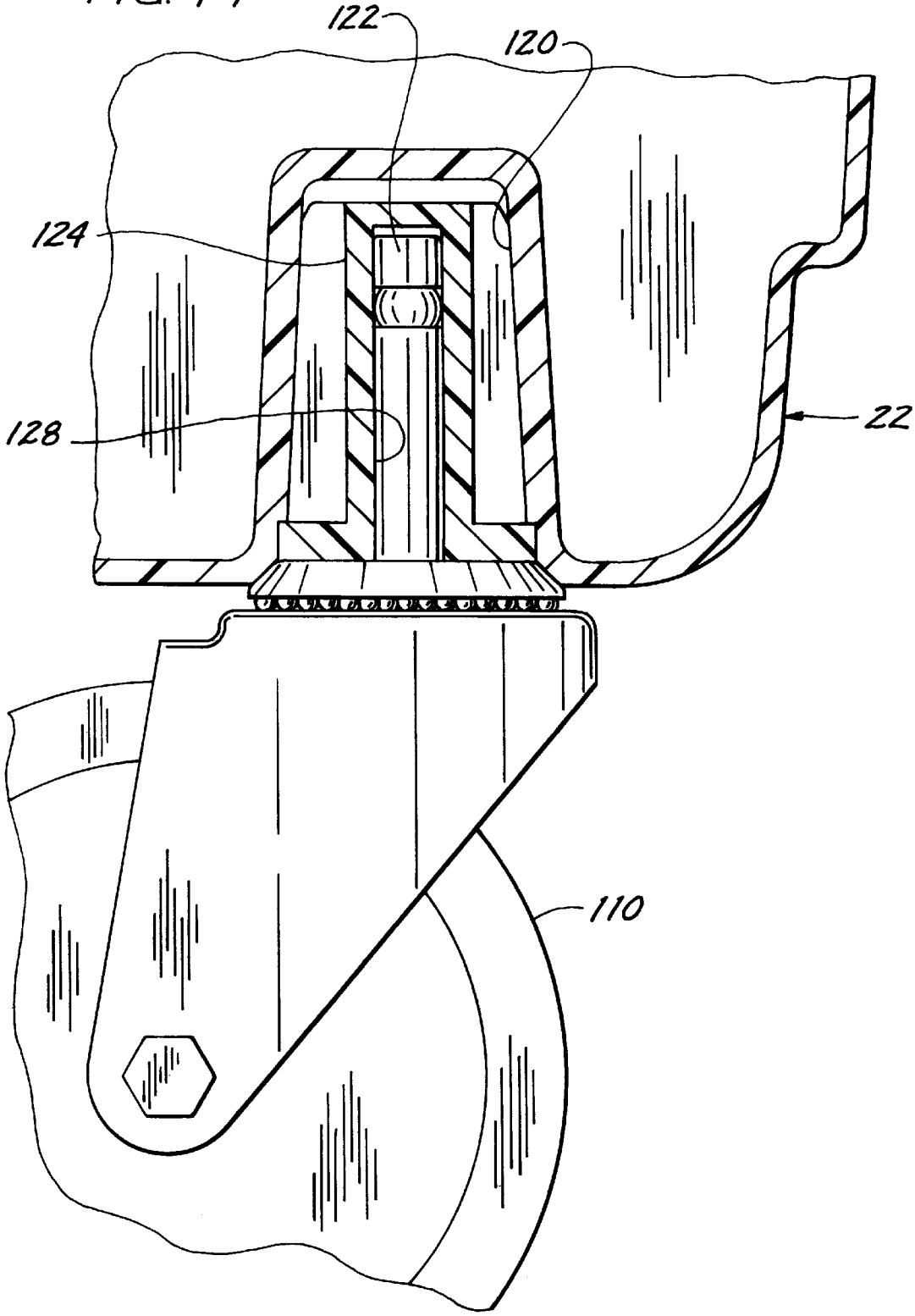
FIG. 17 is an enlarged, fragmented, partial cross-sectional view showing detail of a caster received within the caster socket.

The container 20 preferably includes a pair of casters 110 located near the front of the container, and a pair of wheels 112 located near the rear of the container. The casters 110 and the wheels 112 facilitate transport of the container, which may be rather heavy when full. The wheels 112 are mounted to the container body 22 by an axle 114. As shown in FIGS. 4 and 6, the axle passes through two bearings 116, which are preferably molded integrally with the container body 22. The casters 110 are mounted to the container body 22 for swiveling movement relative thereto. As shown in FIG. 16, the container body 22 includes a caster socket 120 for each caster 110. Preferably, the caster socket 120 is molded so that the container body 22 and the caster socket 120 are of a monolithic construction. As shown in FIG. 17, each caster 110 includes a caster post 122, which is received within a caster insert 124. The caster insert 124 is, in turn, received within the caster socket 120. Preferably, the caster insert 124 is dimensioned so that it fits tightly within the caster socket 120 in a frictional engagement. The caster insert includes a bore 128 dimensioned to receive the caster post 122. Preferably, the bore 128 is dimensioned so that the caster post 122 fits tightly within the bore 128 in a frictional engagement.

In view of the above, it will be seen that the objects of the invention have been achieved and other advantageous results attained. As various changes could be made without departing from the scope of the invention, it is intended that all matter contained in the above description or shown in the accompanying drawings shall be interpreted as illustrative and not in a limiting sense.

What is claimed is:

1. A container comprising:

a container body having a bottom, first and second side walls extending upwardly from the bottom, and first and second end walls extending upwardly from the bottom, the side walls and end walls defining a mouth of the container;

a rearward lid component adapted for covering a rearward portion of the mouth;

a forward lid component hingedly attached to the rearward lid component by a first hinge assembly for pivoting movement of the forward lid component relative to the rearward lid component about a first hinge axis, the forward lid component being adapted for covering a forward portion of the mouth; and a handle connected to the first end wall of the container body adjacent the mouth of the container, the handle extending generally along a handle axis;

the rearward lid component being hingedly attached to the handle by a second hinge assembly for pivoting movement of the rearward lid component relative to the container body about a second hinge axis;

the forward and rearward lid components being moveable relative to one another via the first hinge assembly through a range of relative positions, one position of the range of positions constituting a lid disconnecting position, the first hinge assembly being adapted to permit the forward and rearward lid components to move laterally relative to one another to facilitate separation of the lid components from one another when the lid components are oriented in the lid disconnecting position;

wherein the first hinge assembly includes a first generally tubular hinge member and first and second tabs, the first generally tubular hinge member being fixed to one of the rearward lid component and the forward lid component, the first and second tabs extending from the other of the rearward lid component and the forward lid component, the first tubular hinge member including first and second longitudinally disposed slots that allow lateral access to the interior of the first tubular hinge member, the first and second tabs being moveable within an interior of the first tubular hinge member in a manner to permit pivoting movement of the rearward lid component and the forward lid component relative to one another, the first tubular hinge member being configured so that the first slot and the first tab are in alignment with one another and so that the second slot and the second tab are in alignment with one another when the lid components are in their lid disconnecting position to enable the first tab to pass through the first slot and to enable the second tab to pass through the second slot to separate the lid components from one another.

2. The container of claim 1 wherein the handle is connected to the first end wall of the container body in a manner so that the handle is spaced from the first end wall.

3. The container of claim 1 wherein the handle axis is coaxial with the second hinge axis.

4. The container of claim 1 wherein the handle and the container body are of a monolithic construction.

5. The container of claim 1 wherein the first and second hinge assemblies are constructed entirely of non-metal materials.

6. The container of claim 1 wherein the first generally tubular hinge member and the rearward lid component are of a monolithic construction, and wherein the first and second tabs and the forward lid component are of a monolithic construction.

7. The container of claim 1 wherein each of the first and second tabs has a cross-sectional configuration defined by a major lateral dimension and a minor lateral dimension, each of the first and second slots having a lateral width greater than the minor lateral dimension of the tabs to allow the first tab to pass laterally through the first slot and to allow the second tab to pass laterally through the second slot when the first and second tabs are oriented so that the minor lateral dimensions of the first and second tabs are aligned with the first and second slots, respectively, to bring the rearward and forward lid components into and out of hinging engagement with one another, the lateral width of each of the first and second slots being less than the major lateral dimension of each of the first and second tabs so that the first and second tabs are retained within the interior of the first tubular hinge member when the first and second tabs are oriented so that the minor lateral dimension of each of the first and second tabs is not aligned with the first and second slots, respectively.

8. The container of claim 7 wherein the first tubular hinge member includes a first interior end wall within the interior of the first tubular hinge member at one end thereof and a second interior end wall within the interior of the first tubular hinge member at an opposite end thereof, the first and second interior end walls being generally perpendicular to the first and second longitudinally disposed slots of the first tubular hinge member, the first and second tabs each including a distal end surface adapted for abutting engagement with one of the interior end walls of the first tubular hinge member when the rearward and forward lid components are in hinging engagement with one another.

9. The container of claim 8 wherein the distal end surface of each of the first and second tabs includes a projection extending longitudinally away from the distal end surface, the interior end walls of the first tubular hinge member each including a recess adapted for receiving one of the projections in a snap-fit engagement.

10. The container of claim 9 wherein said projections and said recesses all lie generally along the first hinge axis so that said projections rotate within said recesses as the forward and rearward lid components pivot relative to one another.

11. The container of claim 1 wherein the rearward lid component is moveable relative to the container body via the second hinge assembly through a range of relative positions, one position of the range of positions constituting a lid disconnecting position, the second hinge assembly being adapted to permit the rearward lid component to move laterally relative to the handle axis to facilitate separation of the rearward lid component from the container body when the rearward lid component is oriented in the lid disconnecting position.

12. The container of claim 11 wherein the second hinge assembly includes a second generally tubular hinge member and first and second tabs, the second tubular hinge member being fixed to one of the rearward lid component and the handle, the first and second tabs extending from the other of the rearward lid component and the handle, the second tubular hinge member including first and second longitudinally disposed slots that allow lateral access to the interior of the second tubular hinge member, the first and second tabs being moveable within an interior of the second tubular hinge member in a manner to permit pivoting movement of the rearward lid component relative to the handle and the container body, the second tubular hinge member being configured so that the first slot and the first tab are in alignment with one another and so that the second slot and the second tab are in alignment with one another when the rearward lid component is in its lid disconnecting position to enable the first tab to pass through the first slot and to enable the second tab to pass through the second slot to separate the rearward lid component from the handle.

13. The container of claim 12 wherein the second generally tubular hinge member and the handle are of a monolithic construction, and wherein the first and second tabs and the rearward lid component are of a monolithic construction.

14. The container of claim 12 wherein each of the first and second tabs has a cross-sectional configuration defined by a major lateral dimension and a minor lateral dimension, each of the first and second slots having a lateral width greater than the minor lateral dimension of the tabs to allow the first tab to pass laterally through the first slot and to allow the second tab to pass laterally through the second slot when the first and second tabs are oriented so that the minor lateral dimensions of the first and second tabs are aligned with the first and second slots, respectively, to bring the rearward lid component and the handle into and out of hinging engagement with one another, the lateral width of each of the first and second slots being less than the major lateral dimension of each of the first and second tabs so that the first and second tabs are retained within the interior of the second tubular hinge member when the first and second tabs are oriented so that the minor lateral dimension of each of the first and second tabs is not aligned with the first and second slots, respectively.

15. A container comprising:

a container body having a bottom and a plurality of side walls extending upwardly from the bottom to define a mouth of the container;

a first lid component adapted for covering a first portion of the mouth, the first lid component having a generally tubular hinge member with first and second longitudinally disposed slots that allow access to an interior of the tubular hinge member; and a second lid component adapted for covering a second portion of the mouth, the second lid component having first and second tabs extending from the second lid component, the first and second tabs being moveable within the interior of the tubular hinge member of the first lid component in a manner so that the first and second lid components are in hinging engagement with one another, each of the first and second tabs having a cross-sectional configuration defined by a major lateral dimension and a minor lateral dimension, each of the first and second slots in the tubular hinge portion of the first lid component having a lateral width greater than the minor lateral dimension of the tabs to allow the first tab to pass laterally through the first slot and to allow the second tab to pass laterally through the second slot when the first and second tabs are oriented so that the minor lateral dimensions of the first and second tabs are aligned with the first and second slots, respectively, to bring the first and second lid components into and out of hinging engagement with one another, the lateral width of each of the first and second slots being less than the major lateral dimension of each of the first and second tabs so that the first and second tabs are retained within the interior of the tubular hinge member when the first and second tabs are oriented so that the minor lateral dimensions of the first and second tabs are not aligned with the first and second slots, respectively.

16. The container of claim 15 wherein the first lid component and the tubular hinge member are of a monolithic construction, and wherein the second lid component and the first and second tabs are of a monolithic construction.

17. The container of claim 16 wherein the first lid component, the tubular hinge member, the second lid component and the first and second tabs are all constructed entirely of non-metal materials.

18. The container of claim 15 wherein the tubular hinge member includes a first end wall within the interior of the tubular hinge member at one end thereof and a second end wall within the interior of the tubular hinge member at an opposite end thereof, the first and second end walls being generally perpendicular to the first and second longitudinally disposed slots of the tubular hinge member, the first and second tabs each including a distal end surface adapted for abutting engagement with one of the end walls of the tubular hinge member when the first and second lid components are in hinging engagement with one another.

19. The container of claim 18 wherein the distal end of each of the first and second tabs includes a projection extending longitudinally therefrom, the end walls of the tubular hinge member each including a recess adapted for receiving one of the projections in a snap-fit engagement.

20. The container of claim 19 wherein the first and second lid components are adapted for pivoting movement relative to one another about a hinge axis, said projections and said recesses all lying generally along the hinge axis so that said projections rotate within said recesses as the first and second lid components pivot relative to one another.

21. The container of claim 15 wherein the tubular hinge member of the first lid component constitutes a first tubular hinge member, the container body having a second generally tubular hinge member adjacent the mouth of the container, the second tubular hinge member having third and fourth longitudinally disposed slots that allow access to an interior of the second tubular hinge member;

the first lid component having third and fourth tabs moveable within the interior of the second tubular hinge member in a manner so that the first lid component and the container body are in hinging engagement with one another, each of the third and fourth tabs having a cross-sectional configuration defined by a major lateral dimension and a minor lateral dimension, each of the third and fourth slots having a lateral width greater than the minor lateral dimension of the third and fourth tabs to allow the third tab to pass laterally through the third slot and to allow the fourth tab to pass laterally through the fourth slot when the third and fourth tabs are oriented so that the minor lateral dimensions of the third and fourth tabs are aligned with the third and fourth slots to bring the first lid component and the container body into and out of hinging engagement with one another, the lateral width of each of the third and fourth slots being less than the major lateral dimension of each of the third and fourth tabs so that the third and fourth tabs are retained within the interior of the second tubular hinge member when the third and fourth tabs are oriented so that the minor lateral dimension of each of the third and fourth tabs are not aligned with the third and fourth slots, respectively.

22. The container of claim 21 wherein the first lid component and the container body are adapted for pivoting movement relative to one another about a hinge axis via the second tubular hinge member and third and fourth tabs, the container body including an elongate handle that extends longitudinally along the hinge axis.

23. The container of claim 22 wherein the container body, the second tubular hinge member and the handle are all of a monolithic construction.

24. The container of claim 22 wherein the second tubular hinge member and the handle are of a monolithic constriction.

25. The container of claim 24 wherein the handle and the second tubular hinge member are constructed entirely of non-metal materials.

* * * * *